US006058901A

United States Patent [19]

Lee

[11] Patent Number: 6,058,901

[45] Date of Patent: May 9, 2000

[54] OFFSET CRANKSHAFT ENGINE

[75] Inventor: Chun Liang Lee, Novi, Mich.

[73] Assignee: Ford Global Technologies, Inc., Dearborn, Mich.

[21] Appl. No.: 09/185,313

[22] Filed: Nov. 3, 1998

[51] Int. Cl.[7] ..... F02B 75/32; F02B 75/22

[52] U.S. Cl. ..... 123/197.1; 123/197.4; 123/54.1; 123/54.4; 123/53.1

[58] Field of Search ..... 123/197.1, 197.4, 123/53.1, 53.3, 53.5, 54.1–54.8

[56] References Cited

U.S. PATENT DOCUMENTS

| | | | |
|---|---|---|---|
| 1,174,722 | 3/1916 | Hickey | 123/54.4 |
| 1,531,430 | 3/1925 | Wrentmore | 123/54.7 |
| 1,601,344 | 9/1926 | Burtnett | 123/54.4 |
| 1,710,083 | 4/1929 | Barrell | 123/54.4 |
| 1,790,198 | 1/1931 | Cizek | 123/53.1 |
| 1,874,195 | 8/1932 | King | 123/53.1 |
| 2,957,455 | 10/1960 | Bouvy | 121/120 |
| 2,966,146 | 12/1960 | Schweitzer | 123/54.6 |
| 2,974,541 | 3/1961 | Dolza | 74/579 |
| 4,664,077 | 5/1987 | Kamimaru | 123/53.1 |
| 4,945,866 | 8/1990 | Chabot, Jr. | 123/53.1 |
| 5,816,201 | 10/1998 | Garvin | 123/53.1 |

OTHER PUBLICATIONS

JSAE Conference Proceedings 966, 2996–10.

Automotive Engineering, May 1991, "VW's narrow angle VR6 engine".

*Primary Examiner*—Tony M. Argenbright

*Assistant Examiner*—Brian Hairston

*Attorney, Agent, or Firm*—Jerome R. Drouillard

[57] ABSTRACT

The cylinders (12; 48, 50) are disposed such that each piston-cylinder axis (16; 56, 58) does not intersect the crankshaft axis (20; 47). Timing of combustion within each cylinder is controlled to cause maximum combustion pressure to occur when an imaginary plane that contains both a respective connection axis (28; 66, 70) of a respective connecting rod (24; 62, 64) to the respective piston (14; 52, 54) and a respective connection axis (30; 68, 72) of the connecting rod to a respective throw of the crankshaft is substantially coincident with the respective cylinder axis along which the piston reciprocates. In a V-type engine the axes of those cylinders in a respective bank are disposed in a respective imaginary plane (76; 78) forming a respective side of a V. The respective imaginary planes intersect along an imaginary line (74) that is parallel to the crankshaft axis and spaced from the crankshaft axis by a distance (A) substantially equal to the distance (A) by which the connection axis of each connecting rod to the respective throw is spaced from the crankshaft axis when the imaginary plane that contains both the respective connection axis to the respective piston and the respective connection axis to the respective throw is substantially coincident with the respective cylinder axis.

5 Claims, 3 Drawing Sheets

OFFSET CRANKSHAFT ENGINE

BACKGROUND OF THE INVENTION

1. Field of the Invention

This invention relates generally to reciprocating piston type internal combustion (I.C.) engines. More specifically it relates to such an I.C. engine in which the axes of the pistons do not intersect, i.e. are geometrically offset from, the crankshaft axis.

2. Background Information

Certain technology relating to reciprocating piston I.C. engines in which the crankshaft axis is offset from the piston-cylinder axes is described in U.S. Pat. Nos. 810,347; 2,957,455; 2,974,541; 4,628,876; and 4,945,866; in Japan patent document 60-256,642; in Soviet Union patent document 1551-880-A; and in JSAE Conference proceedings 966, 1996-10. According to descriptions contained in those publications, the various engine geometries are motivated by various considerations, including power and torque improvements and friction and vibration reductions.

A production V-type engine in which the crankshaft axis is offset from the piston-cylinder axes is the Volkswagen narrow V engine, which has six cylinders and a 15° V, and is known as the VR6 engine. Because a 15° V is quite narrow for a V-type engine, it is believed that a reason for offsetting the crankshaft axis is to control the height of the engine.

In-line, or straight, engines in which the crankshaft axis is offset from the piston axes were used in early twentieth century racing engines.

SUMMARY OF THE INVENTION

The present invention relates to further improvements in reciprocating piston I.C. engines in which the crankshaft axis is offset from the piston axes.

One general aspect of the invention relates to a multiple cylinder internal combustion engine comprising: a crankshaft, comprising multiple throws, journaled for rotation about a main axis of the engine; multiple cylinders within each of which a respective piston reciprocates along a respective piston-cylinder axis as the respective piston executes a repeating operating cycle that comprises a power stroke during which combustion pressure is applied to the respective piston; the cylinders being disposed such that each piston-cylinder axis does not intersect the main axis; multiple connecting rods each of which connects a respective piston with a respective throw to relate reciprocal motion of the respective piston to rotation of the crankshaft; each connecting rod being attached to a respective piston and to a respective throw such that as the respective piston reciprocates within the respective cylinder, the respective connecting rod oscillates relative to the respective piston over an acute angular span about a respective piston connection axis parallel to the main axis and revolves on the respective throw about a respective throw connection axis that is parallel to and spaced from the main axis; and a control for controlling timing of combustion within each respective cylinder to cause maximum combustion pressure within a respective cylinder during a power stroke to occur when an imaginary plane that contains both the respective piston connection axis and the respective throw connection axis is substantially coincident with the respective piston-cylinder axis.

Another general aspect relates to a method of operating a multiple cylinder internal combustion engine, ne engine comprising: a crankshaft, comprising multiple throws, journaled for rotation about a main axis of the engine; multiple cylinders within each of which a respective piston reciprocates along a respective piston-cylinder axis as the respective piston executes a repeating operating cycle that comprises a power stroke during which combustion pressure is applied to the respective piston; the cylinders being disposed such that each piston-cylinder axis does not intersect the main axis; multiple connecting rods each of which connects a respective piston with a respective throw to relate reciprocal motion of the respective piston to rotation of the crankshaft; each connecting rod being attached to a respective piston and to a respective throw such that as the respective piston reciprocates within the respective cylinder, the respective connecting rod oscillates relative to the respective piston over an acute angular span about a respective piston connection axis parallel to the main axis and revolves on the respective throw about a respective throw connection axis that is parallel to and spaced from the main axis; the method comprising controlling timing of combustion within each respective cylinder to cause maximum combustion pressure within a respective cylinder during a power stroke to occur when an imaginary plane that contains both the respective piston connection axis and the respective throw connection axis is substantially coincident with the respective piston-cylinder axis.

Still another general aspect relates to a multiple cylinder internal combustion engine comprising: a crankshaft, comprising multiple throws, journaled for rotation about a main axis of the engine; multiple cylinders within each of which a respective piston reciprocates along a respective piston-cylinder axis as the engine operates; some of the cylinders being arranged to form a first cylinder bank in which the corresponding piston-cylinder axes occupy a common first imaginary cylinder plane that is spaced from, and parallel to, the main axis; others of the cylinders being arranged to form a second cylinder bank in which the corresponding piston-cylinder axes occupy a common second imaginary cylinder plane that is spaced from, and parallel to, the main axis; multiple connecting rods each of which connects a respective piston with a respective throw to relate reciprocal motion of the respective piston to rotation of the crankshaft; each connecting rod being attached to a respective piston and go a respective throw such that as the respective piston reciprocates within the respective cylinder, the respective connecting rod oscillates relative to the respective piston over an acute angular span about a respective piston connection axis parallel to the main axis and revolves on the respective throw about a respective throw connection axis that is parallel to and spaced from the main axis; and the first and second imaginary cylinder planes intersecting along an imaginary line that is parallel to the main axis and that is spaced substantially equidistant from two imaginary reference planes, a first of which contains the main axis and is parallel to the first imaginary cylinder plane, and a second of which contains the main axis and is parallel to the second imaginary cylinder plane.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT(S)

Figure 1:
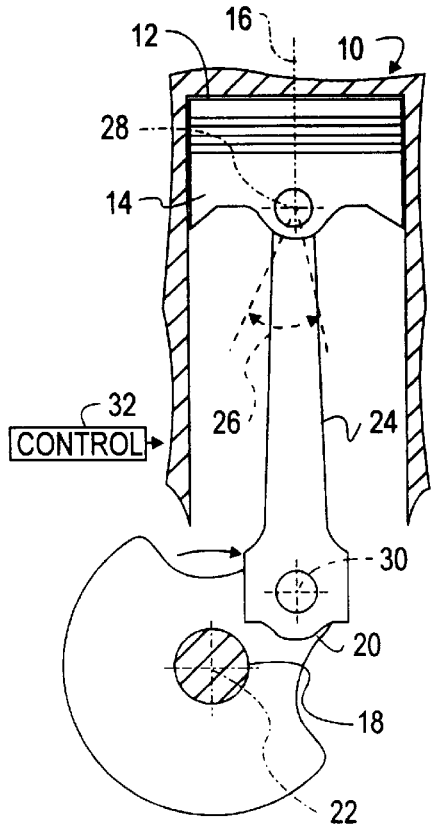
FIG. 1 is a cross section view through an engine cylinder looking along a main axis of an engine.

FIG. 1 shows a portion of a representative internal combustion engine 10 incorporating principles of the present invention. The Figure shows an engine combustion cylinder 12 within which a piston 14 reciprocates along a piston-cylinder axis 16. A crankshaft 18, comprising a throw 20, is journaled for rotation about a main axis 22. The direction of rotation is represented by the curved arrow. A connecting rod 24 connects piston 14 with throw 20 to relate reciprocal motion of piston 14 and rotation of crankshaft 18.

Connecting rod 24 is attached to piston 14 and to throw 20 such that as piston 14 reciprocates within cylinder 12, connecting rod 24 oscillates relative to the piston over an acute angular span 26 about a piston connection axis 28 parallel to main axis 22 and revolves on the crankshaft throw about a respective throw connection axis 30 that is parallel to and spaced from main axis 22.

It is to be understood that the Figure is presented for clarity in illustration of the inventive principles, and therefore, certain details such as piston rings, crankshaft bearings, etc. are not specifically portrayed although they may be present in an actual engine.

A control 32 controls timing of combustion within cylinder 12 to cause maximum combustion pressure within the cylinder during a power stroke to occur when an imaginary, plane that contains both axis 28 and axis 30 is substantially coincident with axis 16. that Position is the position shown by FIG. 1. Such a control may be a spark timing control in the case of a spark ignited internal combustion engine.

Figure 3:
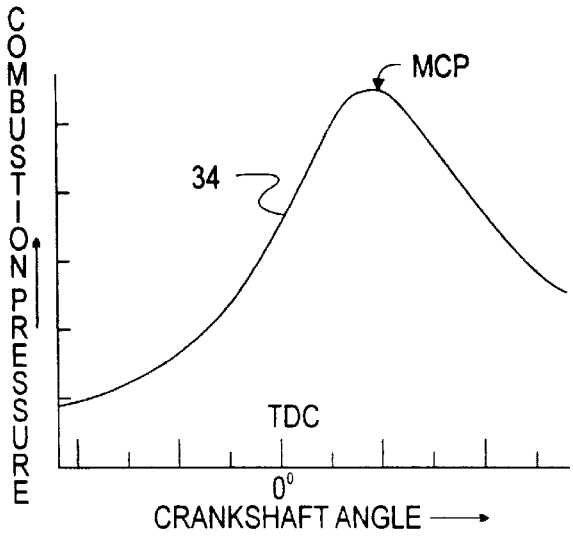
FIG. 3 is a illustrative graph plot on a non-dimensional scale.

FIG. 3 displays a representative graph plot 34 of cylinder combustion pressure as a function of crankshaft angle of rotation immediately preceding and during combustion. Although the graph plot is non-dimensional, the location of piston top dead center (TDC) position is marked for the purpose of showing that maximum combustion pressure MCP occurs during a power stroke after the piston has passed TDC.

Important benefits are believed to result by timing the combustion process such that the maximum combustion pressure within cylinder 12 occurs when the imaginary plane that contains both axis 28 and axis 30 is substantially coincident with axis 16, meaning coincident within one or two degrees of crankshaft rotation.

Because of the offset of the crankshaft axis, the piston will be past TDC as the combustion pressure builds no toward its peak pressure MCP. It therefore becomes possible for the axis of the connecting rod to be substantially coincident with the co-axis of the piston and cylinder when that peak is reached. As a result, there is at that instant, at least theoretically, no side force acting on the piston. Friction between the piston and the cylinder wall is significantly reduced, essentially to that caused by the piston rings bearing against the cylinder wall. While it is true that the piston may encounter side force at and immediately after leaving TDC, such force would be encountered at times when the piston would be moving more slowly than it would when the connecting rod axis is coincident with the piston-cylinder co-axis, and moreover, the combustion pressure is, at that time, still well below its peak. It is believed that a meaningful improvement in efficiency of transmitting piston stroking to cranking motion results because a lesser amount of energy is dissipated by friction over the full duration of a cylinder's operating cycle that comprises intake, compression, power, and exhaust strokes spanning 720° of crankshaft rotation in a four-stroke I.C. engine.

It is also believed that some reduction in loads imposed on the crankshaft main bearings may be obtained because the connecting rod axis is coincident with the piston-cylinder co-axis at the time that maximum force must be reacted by the adjacent bearings.

Figure 2:
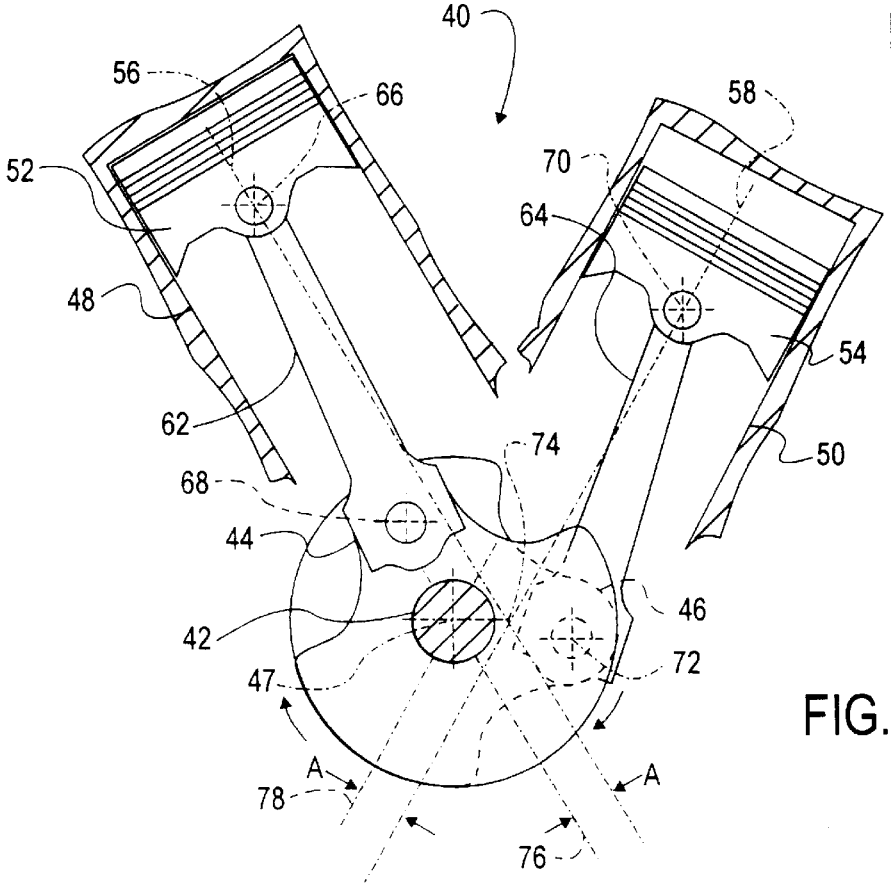
FIG. 2 is a cross section view through the two cylinder banks of a V-type engine looking along a main axis of the engine.

FIG. 2 shows principles of the invention applied to a multiple cylinder, V-type engine 40. A crankshaft 42 having multiple throws, such as 44, 46, is journaled for rotation about a main axis 47 of engine 40. Each of multiple cylinders, such as 48, 50, contains a respective piston, such as 52, 54, which reciprocates along a respective piston-cylinder axis, such as 56, 58, as engine 40 operates. Cylinder 48 is representative of one of multiple cylinders arranged to form a first cylinder bank in which corresponding piston-cylinder axes 56 occupy a common first imaginary cylinder plane that is spaced from, and parallel to, main axis 47. Cylinder 50 is representative of one of multiple other cylinders arranged to form a second cylinder bank in which the corresponding piston-cylinder axes 58 occupy a common second imaginary cylinder plane that is spaced from, and parallel to, main axis 47. In each cylinder bank the respective pistons execute respective operating cycles in properly phased relation so that torque is applied to the crankshaft at fairly regular intervals of crankshaft rotation.

A respective connecting rod 62 connects a respective piston 52 with a respective throw 44 to relate reciprocal motion of the respective piston to rotation of crankshaft 42. A respective connecting rod 64 connects a respective piston 54 with a respective throw 46 to relate reciprocal motion of the respective piston to rotation of crankshaft 42.

Each connecting rod 62 is attached to a respective piston 52 and to a respective throw 44 such that as the respective piston 52 reciprocates within the respective cylinder 48, the respective connecting rod 62 oscillates relative to the respective piston 52 over an acute angular span about a respective piston connection axis 66 parallel to main axis 47 and revolves on the respective throw 44 about a respective throw connection axis 68 that is parallel to and spaced from main axis 47.

Each connecting rod 64 is attached to a respective piston 54 and to a respective throw 46 such that as the respective piston 54 reciprocates within the respective cylinder 50, the respective connecting rod 64 oscillates relative to the respective piston 54 over an acute angular span about a respective piston connection axis 70 parallel to main axis 47 and revolves on the respective throw 46 about a respective throw connection axis 72 that is parallel to and spaced from main axis 47. All connecting rods 62, 64 are identical in that the distance between axis 66 and axis 68 in all connecting rods 62 and between axis 70 and axis 72 in all connecting rods 64 is the same.

The first and second imaginary cylinder planes intersect along an imaginary line 74 that is parallel to main axis 47 and that is spaced substantially equidistant (dimensions A in FIG. 3) from two imaginary reference planes, a first 76 of Which contains main axis 47 and is parallel to the first imaginary cylinder plane, and a second 78 of which contains main axis 47 and is parallel to the second imaginary cylinder plane.

The positions of the two pistons illustrated in FIG. 2 denote at least an approximate relative phasing between them within their respective cylinders with piston 52 being shown substantially at its TDC position. It can be appreciated that at TDC each axis 68, 72 has just passed through the respective plane 76, 78.

Figure 4:
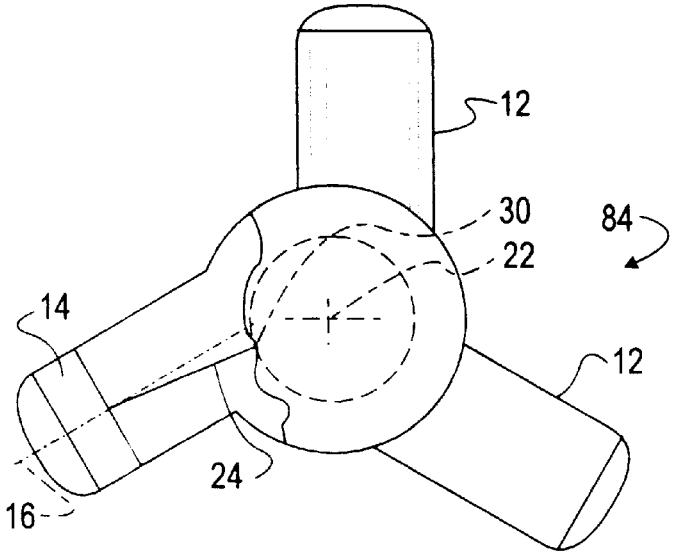
FIG. 4 is a view in the same direction as the views of FIGS. 1 and 2, but somewhat diagrammatic, of a three-cylinder radial engine embodying principles of this invention.

FIG. 4 shows a three-cylinder radial engine 84 in which each cylinder has a configuration like that shown in FIG. 1, and the same reference numerals that were used in FIG. 1 designate like parts in FIG. 4. The respective pistons of engine 84 are suitably phased in their cylinders. Maximum combustion pressure in each cylinder occurs when the connecting rod axis is coincident with the respective piston-cylinder axis. The inventive principles may be applied to various other radial engines.

Figure 5:
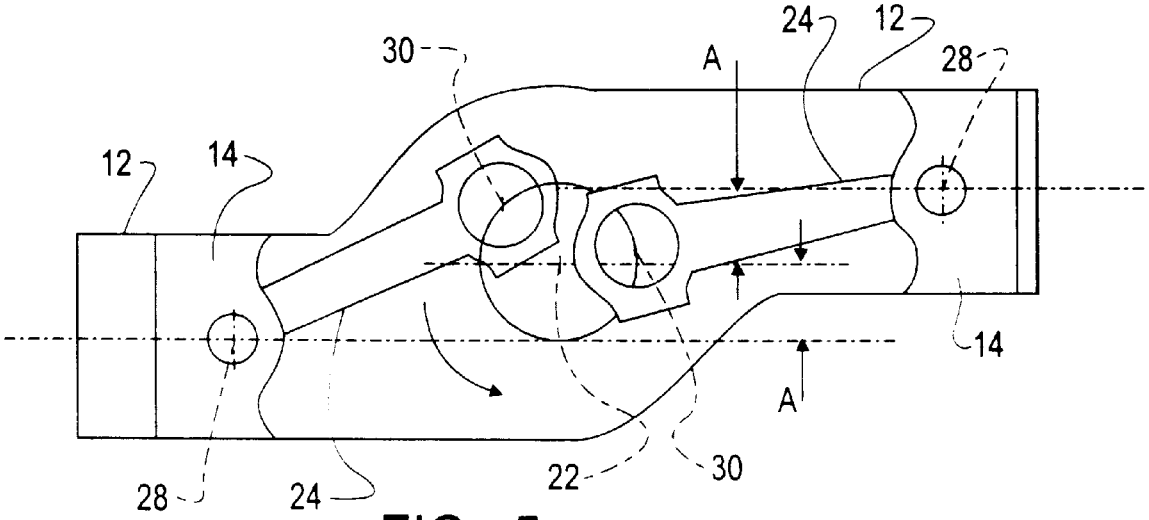
FIG. 5 is a view in the same direction as the views of FIGS. 1 and 2 of a boxer type engine embodying principles of the invention.

FIG. 5 shows a boxer-type engine in which each cylinder has a configuration like that shown in FIG. 1, and the same reference numerals that were used in FIG. 1 designate like parts in FIG. 5. The respective pistons are phased in opposition in their cylinders. Maximum combustion pressure in each cylinder occurs when the connecting rod axis is coincident with the respective piston-cylinder axis.

Figure 6:
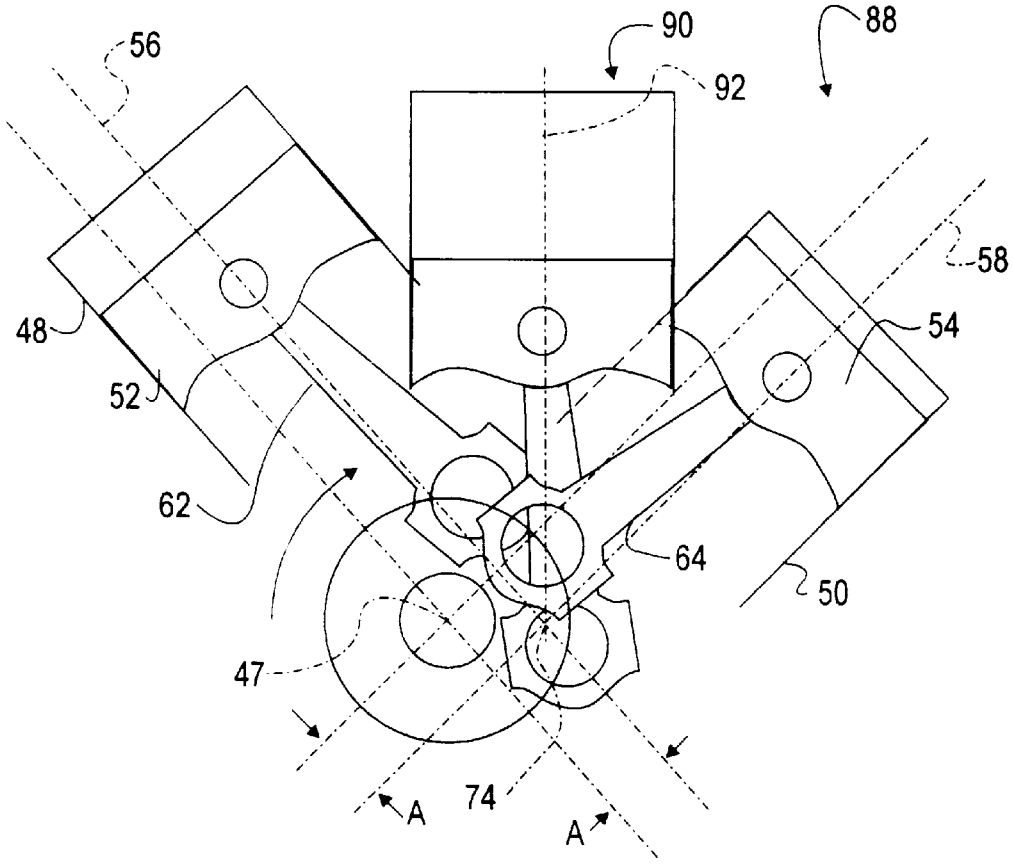
FIG. 6 is a view in the same direction as the views of FIGS. 1 and 2 of a W-type engine embodying principles of the invention.

FIG. 6 shows a W-type engine 88 in which each cylinder has a configuration like that shown in FIG. 1, and the respective pistons are suitably phased in their cylinders. This engine is like a V-engine but with a third cylinder bank 90. The same reference numerals from FIG. 2 are used in FIG. 6 to designate like parts of the two outer cylinder banks. The third cylinder bank 90 is nested within the V formed by the first two cylinder banks. It is to be observed that an imaginary plane 92 containing the piston-cylinder axes of the third cylinder bank also contains imaginary line 76. Combustion is controlled such that maximum combustion pressure in each cylinder occurs when the connecting rod axis is coincident with the respective piston-cylinder axis.

While a presently preferred embodiment has been illustrated and described, it is to be appreciated that the invention may be practiced in various forms within the scope of the following claims.

What is claimed is:

1. A multiple cylinder internal combustion engine comprising:

a crankshaft, comprising multiple throws, journaled for rotation about a main axis of the engine;

multiple cylinders within each of which a respective piston reciprocates along a respective piston-cylinder axis as the respective piston executes a repeating operating cycle that comprises a power stroke during which combustion pressure is applied to the respective piston;

the cylinders being disposed such that each piston-cylinder axis does not intersect the main axis;

multiple connecting rods each of which connects a respective piston with a respective throw to relate reciprocal motion of the respective piston and rotation of the crankshaft;

each connecting rod being attached to a respective piston and to a respective throw such that as the respective piston reciprocates within the respective cylinder the respective connecting rod oscillates relative to the respective piston over an acute angular span about a respective piston connection axis parallel to the main axis and revolves on the respective throw about a respective throw connection axis that is parallel to and spaced from the main axis;

and a control for controlling timing of combustion within each respective cylinder to cause maximum combustion pressure within a respective cylinder during a power stroke to occur when an imaginary plane that contains both the respective piston connection axis and the respective throw connection axis is substantially coincident with the respective piston-cylinder axis; and in which some of the cylinders are arranged to form a first cylinder bank in which the corresponding piston-cylinder axes occupy a common first imaginary cylinder plane that is spaced from, and parallel to, the main axis, others of the cylinders are arranged to form a second cylinder bank in which the corresponding piston-cylinder axes occupy a common second imaginary cylinder plane that is spaced from, and parallel to, the main axis, and the first and second imaginary cylinder planes intersect along an imaginary line that is parallel to the main axis and that is spaced substantially equidistant from two imaginary reference planes, a first of which contains the main axis and is parallel to the first imaginary cylinder plane, and a second of which contains the main axis and is parallel to the second imaginary cylinder plane, wherein each of the first and second imaginary cylinder planes is spaced from the main axis in the same circumferential direction as viewed axially of the main axis.

2. A multiple cylinder internal combustion engine comprising:

a crankshaft, comprising multiple throws, journaled for rotation about a main axis of the engine;

multiple cylinders within each of which a respective piston reciprocates along a respective piston-cylinder axis as the engine operates;

some of the cylinders being arranged to form a first cylinder bank in which the corresponding piston-cylinder axes occupy a common first imaginary cylinder plane that is spaced from, and parallel to, the main axis;

others of the cylinders being arranged to form a second cylinder bank in which the corresponding piston-cylinder axes occupy a common second imaginary cylinder plane that is spaced from, and parallel to, the main axis;

multiple connecting rods each of which connects a respective piston with a respective throw to relate reciprocal motion of the respective piston to rotation of the crankshaft;

each connecting rod being attached to a respective piston and to a respective throw such that as the respective piston reciprocates within the respective cylinder, the respective connecting rod oscillates relative to the respective piston over an acute angular span about a respective piston connection axis parallel to the main axis and revolves on the respective throw about a respective throw connection axis that is parallel to and spaced from the main axis;

and the first and second imaginary cylinder planes intersecting along an imaginary line that is parallel to the main axis and that is spaced substantially equidistant from two imaginary reference planes, a first of which contains the main axis and is parallel to the first imaginary cylinder plane, and a second of which contains the main axis and is parallel to the second imaginary cylinder plane, wherein each of the first and second imaginary cylinder planes is spaced from the main axis in the same circumferential direction as viewed axially of the main axis.

3. A multiple cylinder internal combustion engine as set forth in claim 2 further including a control for controlling timing of combustion within each respective cylinder to cause maximum combustion pressure within a respective cylinder during a power stroke to occur when an imaginary plane that contains both the respective piston connection axis and the respective throw connection axis is substantially coincident with the respective piston-cylinder axis.

4. A multiple cylinder internal combustion engine comprising:

a crankshaft, comprising multiple throws, journaled for rotation about a main axis of the engine;

multiple cylinders within each of which a respective piston reciprocates along a respective piston-cylinder axis as the engine operates;

some of the cylinders being arranged to form a first cylinder bank in which the corresponding piston-cylinder axes occupy a common first imaginary cylinder plane that is spaced from, and parallel to, the main axis;

others of the cylinders being arranged to form a second cylinder bank in which the corresponding piston-cylinder axes occupy a common second imaginary cylinder plane that is spaced from, and parallel to, the main axis;

multiple connecting rods each of which connects a respective piston with a respective throw to relate reciprocal motion of the respective piston to rotation of the crankshaft;

each connecting rod being attached to a respective piston and to a respective throw such that as the respective piston reciprocates within the respective cylinder, the respective connecting rod oscillates relative to the respective piston over an acute angular span about a respective piston connection axis parallel to the main axis and revolves on the respective throw about a respective throw connection axis that is parallel to and spaced from the main axis;

and the first and second imaginary cylinder planes intersecting along an imaginary line that is parallel to the main axis and that is spaced substantially equidistant from two imaginary reference planes, a first of which contains the main axis and is parallel to the first imaginary cylinder plane and a second of which contains the main axis and is parallel to the second imaginary cylinder plans; and further including a control for controlling timing of combustion within each respective cylinder to cause maximum combustion pressure within a respective cylinder during a power stroke to occur in advance of the respective connecting rod arriving at an end of the acute angular span of oscillation and when an imaginary plane that contains both the respective piston connection axis and the respective throw connection axis is substantially coincident with the respective piston-cylinder axis.

5. A multiple cylinder internal combustion engine as set forth in claim 4 wherein each of the first and second imaginary cylinder planes is spaced from the main axis in the same circumferential direction as viewed axially of the main axis.

* * * * *